US007750855B2

(12) United States Patent
Wong

(10) Patent No.: US 7,750,855 B2
(45) Date of Patent: Jul. 6, 2010

(54) COMPACT POLARIZATION-SENSITIVE AND PHASE-SENSITIVE ANTENNA WITH DIRECTIONALITY AND MULTI-FREQUENCY RESONANCES

(76) Inventor: Alfred Y. Wong, 13704 Saticoy St., Panorama City, CA (US) 91402

( * ) Notice: Subject to any disclaimer, the term of this patent is extended or adjusted under 35 U.S.C. 154(b) by 60 days.

(21) Appl. No.: 11/696,040

(22) Filed: Apr. 3, 2007

(65) Prior Publication Data

US 2007/0257845 A1 Nov. 8, 2007

Related U.S. Application Data

(60) Provisional application No. 60/744,142, filed on Apr. 3, 2006.

(51) Int. Cl.
*H01Q 1/24* (2006.01)

(52) U.S. Cl. ..... 343/702; 343/700 MS

(58) Field of Classification Search ..... 343/702, 343/797, 700 MS

See application file for complete search history.

(56) References Cited

U.S. PATENT DOCUMENTS 5,629,649 A * 5/1997 Ujiie ..... 331/17
5,966,102 A * 10/1999 Runyon ..... 343/820
6,211,841 B1 * 4/2001 Smith et al. ..... 343/813
6,341,217 B1 * 1/2002 Wong ..... 455/575.5
6,697,641 B1 * 2/2004 Shapira ..... 455/562.1
6,917,337 B2 * 7/2005 Iida et al. ..... 343/702
2004/0203538 A1 * 10/2004 Leppanen et al. ..... 455/101
2006/0137173 A1 * 6/2006 Dunn et al. ..... 29/600

* cited by examiner

*Primary Examiner*—Douglas W Owens
*Assistant Examiner*—Dieu Hien T Duong
(74) *Attorney, Agent, or Firm*—Novak Druce DeLuca + Quigg LLP

(57) ABSTRACT

A modulation system that can be used alone or in conjunction with current modulation techniques for data transmission in portable phones. The system consists of two orthogonal antennas of opposite polarization in which signals can be individually received and processed. A phase delay signal combination system allows combining the signals received on the two paths to allow selective reception of various polarizations. The rate of change between these two antennas will be different for each data signal, allowing a large increase in the number of users.

14 Claims, 9 Drawing Sheets

- Scenario #1: Each patch antenna is fed to a receiver. The two signals will then be combined into a decoding chip for processing.

- Scenario #1: Each patch antenna is fed to a receiver. The two signals will then be combined into a decoding chip for processing.

- Scenario #2: Both antenna outputs will be combined into a balun that gives one output into one receiver.

2.44GHz Patch Antenna

Approximate dimensions: 2" x 1"

2.44GHz Patch Antenna

S11=-12.6 dB
at 2.44 GHz
BW=50 MHz
(2.42~2.47GHz)

2.44GHz Patch Antenna

Electric Field Distribution

2.44GHz Patch Antenna

Radiation Pattern Simulation

COMPACT POLARIZATION-SENSITIVE AND PHASE-SENSITIVE ANTENNA WITH DIRECTIONALITY AND MULTI-FREQUENCY RESONANCES

CROSS-REFERENCE TO RELATED APPLICATION AND CLAIM FOR PRIORITY

This application claims priority under 35 U.S.C. §119(e) from Provisional Application Ser. No. 60/744,142 filed on Apr. 3, 2006.

BACKGROUND OF THE INVENTION

1. Field of the Invention

The present invention relates to the field of antennae for communication, and in particular relates to an integrated antenna design for portable wireless communication devices, which has the built-in capability of increasing the number of users and expanding data transmission by creating new dimensions in coding. Antenna configurations are made compact by specially developed materials of high dielectric constants for this purpose.

2. Description of Prior Art

As the wireless world expands and portable communication devices such as cell phones, Personal Digital Assistants (PDAs), wireless e-mail devices, etc. become increasingly popular, the industry's focus is toward more efficient ways to add users to the saturated frequency spectrum. Many techniques have been developed to increase cellular capacity by separating signals in frequency and time domain.

Modulation schemes transfer data onto a carrier frequency where it is transmitted to a user who then must demodulate the received signal to acquire the data. The popular spread spectrum modulation ensures a secure form of data transfer with systems such as CDMA, Frequency-Hop MPSK, QPSK, etc. . . . .

Current forms of modulation are independent of the type of antenna used. Furthermore, most cell phone antennas are comprised of a simple monopole, which is linearly polarized in the vertical direction. Of the modulation schemes used in cell phone technology today, none incorporate the use of antenna polarization as a parameter in data transfer coding. The present invention advances the concept of two orthogonal antennae in a portable communication device to achieve a new dimension of coding.

SUMMARY OF THE INVENTION

Two orthogonally polarized antennas and two isolated transceivers along with a selective mixing mechanism will provide a rate of change of polarization. This rate of change of polarization will define a system of data modulation that can be used alone or in conjunction with current forms of modulation as they are used in portable phone technology today.

DETAILED DESCRIPTION OF THE PREFERRED EMBODIMENTS

The two antennas are oriented such that one antenna is orthogonal to the other. In this position, one antenna will receive vertical linear polarization, while the other antenna will receive horizontal linear polarization. This creates two distinct modes of operation. If each antenna has a separate receiver, individual signals are received from each antenna. When a vertically polarized signal is transmitted, the vertically polarized antenna will receive this signal. Because of the reflection from buildings and other large objects in urban areas, the horizontally oriented antenna may receive a small portion of the original signal. However, because each antenna has separate circuitry, the vertical polarization can be chosen and the horizontally polarization ignored, and vice versa.

An equivalent method in describing the polarizations can also be to consider the two circular polarizations, i.e., instead of vertical and horizontal polarizations, right-hand circularly polarized and left-hand circularly polarized signals can be discriminated.

Figure 1:
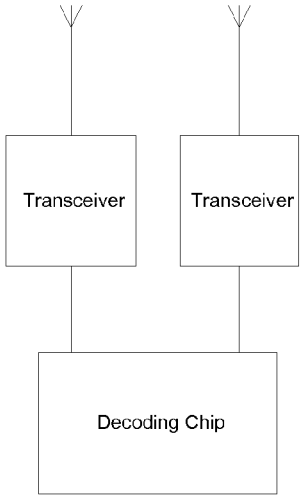
FIG. 1 shows how two antennas are fed into two transceivers whose outputs are determined by a processing chip.
Figure 2:
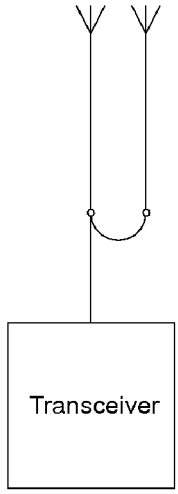
FIG. 2 shows two antenna outputs combined through a balun to yield one output fed into a transceiver.
Figure 3:
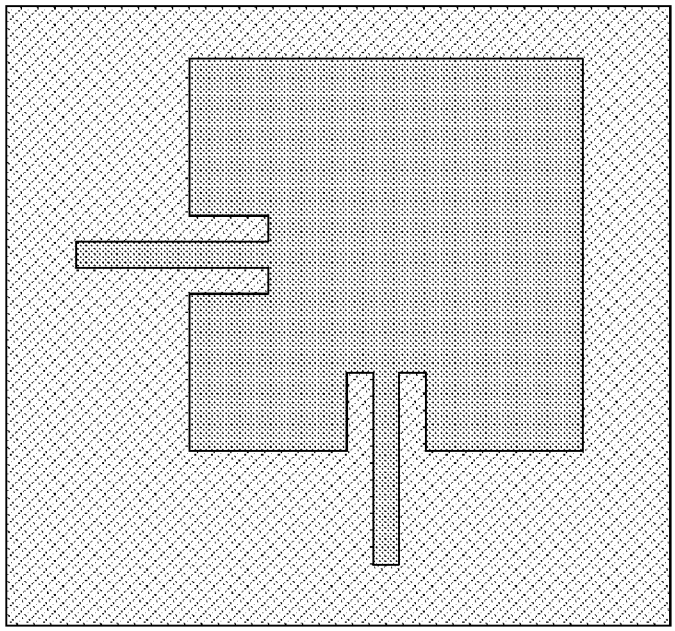
FIG. 3 shows a compact flat antenna having two orthogonal input leads.
Figure 4:
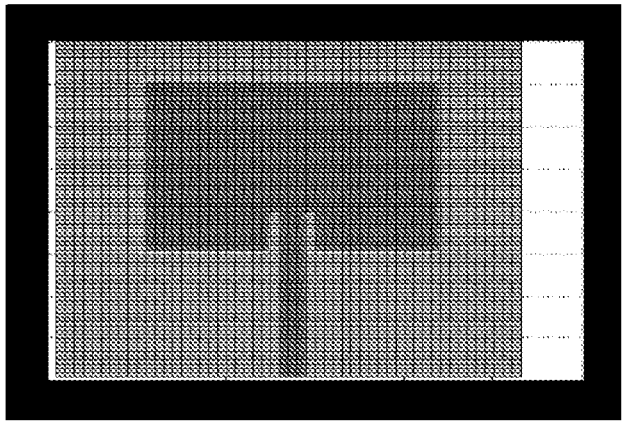
FIG. 4 shows an example of a patch antenna with a single input lead.
Figure 5:
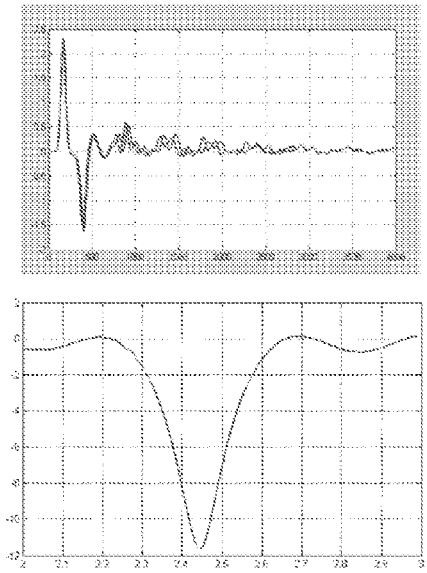
FIG. 5 is a graph showing characteristics of a patch antenna according to the invention.
Figure 6:
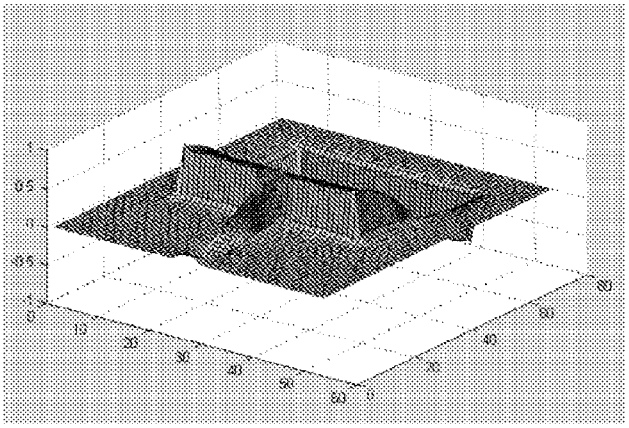
FIG. 6 shows a pictorial example of the electric field distribution of the antenna in three dimensions.
Figure 7:
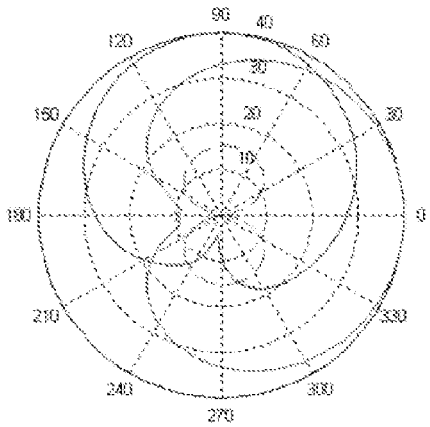
FIG. 7 shows a radiation pattern simulation for the addition of the new dimension and the potential of utilization with all existing modulation techniques.
Figure 8:
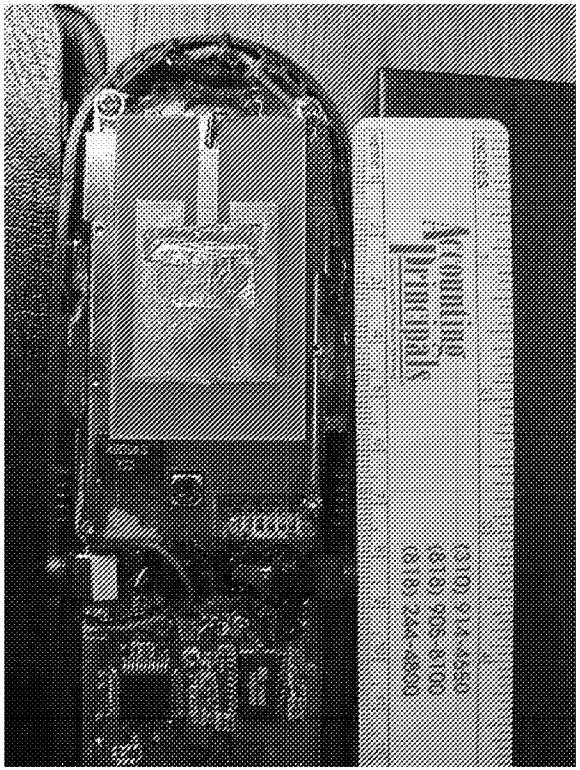
FIG. 8 shows a prototype installed inside a cordless phone showing the use of circuit board with one input lead. The concept can be generalized to a circuit board with orthogonal input leads.
Figure 9:
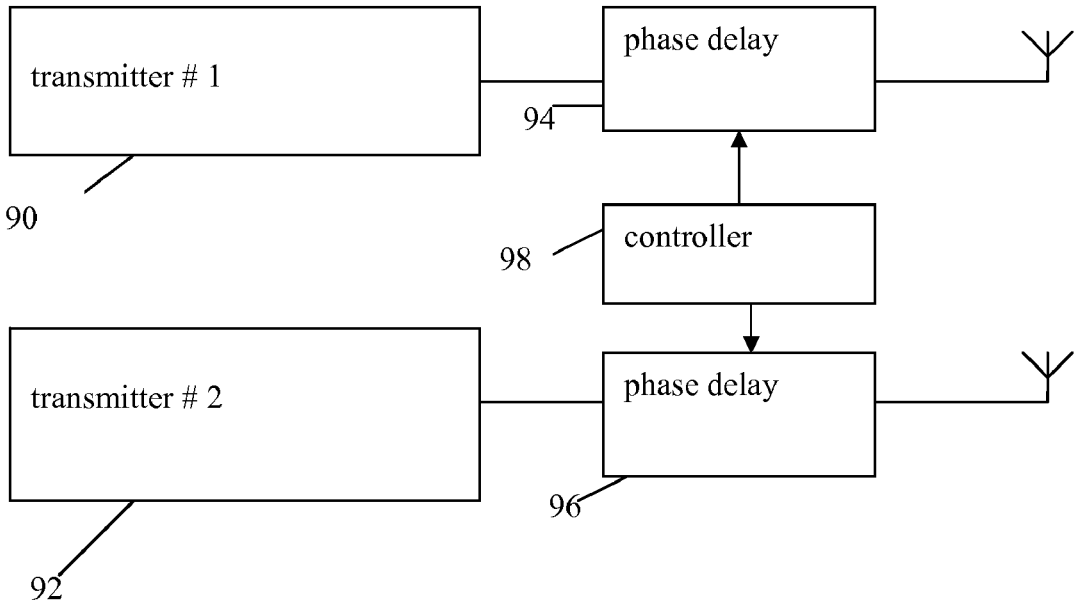
FIG. 9 is a block diagram showing an embodiment of the invention adjusting the phase of signals from two transmitters.

After amplification, the signals from both antennas can be combined with a controlled phase delay. For example, as shown in FIG. 9, signals outputted from a first transmitter 90 and a second transmitter 92 are fed to adjustable phase delay circuits 94 and 96, which are controlled by a controller 98. This allows the selection of the component with a specific rate of change of polarization. The phase can be controlled with an internal frequency standard (such as an oscillator). The accuracy of the internal frequency standard can be maintained by reference to an external frequency standard transmission, such as a signal from a standard source. As shown in FIG. 1, the decoding chip functions to combine the signals from the transceivers and processes the combined signal to detect changes in polarization. The rate of change between linear and vertical polarization will define a new dimension of coding. Numerous users can transmit on the same frequency with the same coding scheme in the frequency domain, and the rate of change of polarization will define the individual signals. This modulation scheme will increase the current technologies by a factor of N, where N is limited only by the switching speed, signal stability, and scattering conditions.

Figure 10:
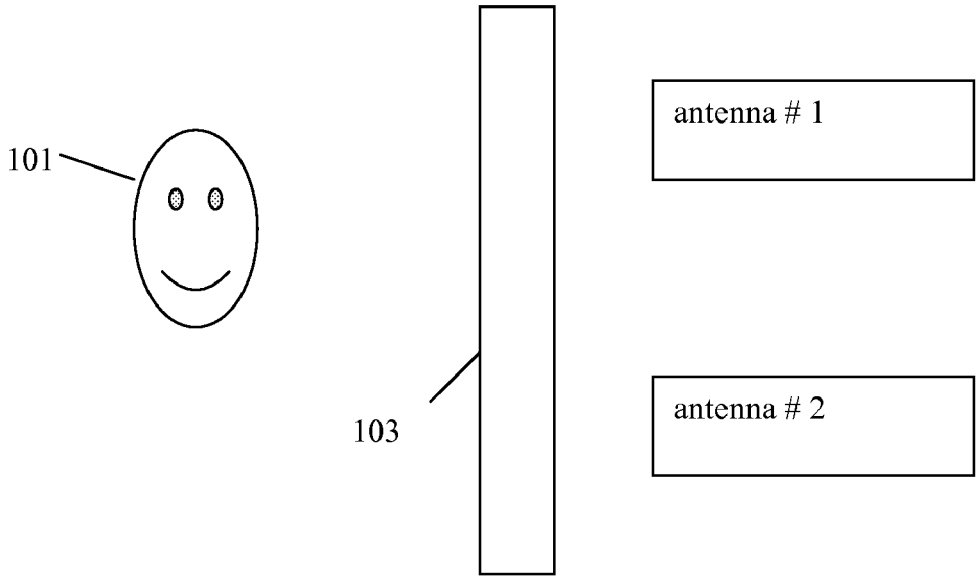
FIG. 10 is a block diagram showing the spacing of a metallic shield between a user and antennas.

As shown in FIG. 10, a non-planar metallic shield 103 may be spaced apart from the antennas #1 and #2 so as to be disposed between the antennas and a user 101. The shield 103 may be spaced apart from the antennas by a distance approximately equal to ¼ of an effective wavelength in a dielectric material of an operating frequency of the transmitters. The dielectric material preferably has a dielectric constant greater than or equal to 50 and low loss characteristics so as to achieve the desired spacing distance.

Figure 11:
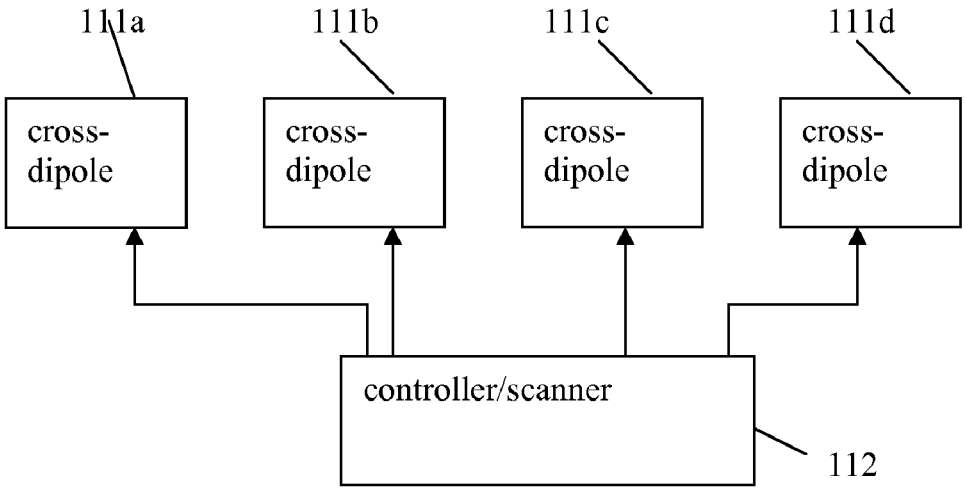
FIG. 11 is a block diagram showing an embodiment of the invention wherein an antenna is formed by an array of spaced-apart cross-dipole radiating elements.

FIG. 11 shows an example embodiment wherein an antenna is formed by a plurality of spaced-apart substantially planar arrays of radiating elements 111*a*-111*d*, wherein each radiating element array can be a pair of orthogonal cross-dipoles. The arrays are spaced apart by a distance approximately equal to ½ of an effective wavelength. A controller/scanner 112 controls the phase and amplitude of each radiating element 111, and scans the antenna elements for a receive or transmit pattern while the polarization is switched at a predetermined rate.

Emphasis is placed on the rate of change of polarization as an important element in the proposed scheme. While metallic media can scatter an incident electromagnetic wave and hence its polarization, the rate of change between these polarizations cannot be changed by the metallic medium.

This new configuration requires two antennas, two transceivers, and an RF combiner to distinguish between the two polarizations. The cell base station can easily be made compatible as it currently uses two orthogonal antennas.

The invention having been disclosed, it will be apparent to those skilled in the art that the same may be varied in many ways without departing from the spirit and scope of the invention. Any and all such modifications are intended to be included in the scope of the following claims.

The invention claimed is:

1. A wireless communication system having a portable device, the portable device comprising:

two radio frequency transmitters;

two radio frequency receivers which are combined with the transmitters;

two radio frequency antennas coupled to the two receivers;

wherein the two receivers receive signals from the two radio frequency antennas and provide input signals to a decoding chip; and wherein said decoding chip receives the input signals from said receivers, combines said input signals into a combined signal, and detects changes and rate of change in polarization of said combined signal.

2. The portable device of claim 1, wherein said two antennas are oriented with respect to each other by approximately 90 degrees.

3. The portable device of claim 1, further comprising a controller which controls the phases of transmitted signals.

4. The portable device of claim 3, wherein said phase is controlled with respect to an internal frequency standard whose accuracy is maintained by an external world-wide transmission.

5. The portable device of claim 1, further comprising a non-planar metallic shield spaced apart from said antennas so as to be disposed between said antennas and a user of the portable communication system.

6. The portable device of claim 5, wherein the non-planar metallic shield is spaced apart from said antennas by a distance approximately equal to ¼ of an effective wavelength in a dielectric material of an operating frequency of the transmitter.

7. The portable device of claim 6, wherein said dielectric material has a dielectric constant greater than or equal to 50 and low loss characteristics such that the distance of ¼ effective wavelength is achieved.

8. A wireless communication system having a portable device, the portable device comprising:

two radio frequency transmitters;

two radio frequency antennas coupled to the two transmitters;

two radio frequency receivers which are combined with the transmitters;

wherein the two receivers receive signals from the two radio frequency antennas and provide input signals to a decoding chip; and wherein said decoding chip which receives the input signals from said receivers, combines said input signals into a combined signal, and detects changes and rate of change of polarization of said combined signal; and at least one of said antennas having a plurality of spaced-apart substantially planar arrays of radiating elements.

9. The portable device of claim 8 wherein the plurality of arrays are spaced apart by a distance approximately equal to ½ of an effective wavelength; each array consists of cross-dipoles which are orthogonal to each other.

10. The portable device of claim 9, further comprising a controller that controls phase and amplitude of the radiating elements.

11. The portable device of claim 10, wherein the controller further includes a scanning means for scanning a receive and transmit pattern of the antennas while the polarization is switched at a predetermined rate.

12. The portable device of claim 11, wherein a transmit beam is directional and a received beam is omnidirectional.

13. The portable device of claim 1, wherein said wireless communication system uses a communication signal coding scheme which combines changes in signal wave polarization with an existing coding scheme using at least one of a frequency, time, or space encoding parameter; wherein the rate of polarization change is added to said existing coding scheme.

14. The wireless communication system according to claim 1, further comprising a base station with which said portable device communicates, said base station being responsive to polarization changes in received communication signal waves and transmitting signals to the portable device of said communication system with predetermined rates of wave polarization change.

* * * * *